US006994412B2

(12) United States Patent
Westdijk et al.

(10) Patent No.: US 6,994,412 B2
(45) Date of Patent: Feb. 7, 2006

(54) PRINTING DEVICE AND CONTROL METHOD THEREOF

(75) Inventors: Jacob Albert Westdijk, Waalre (NL); Eduard Theodorus Hendricus De Grijs, Venlo (NL); Clemens Theodorus Weykamp, Lomm (NL)

(73) Assignee: Oce-Technologies B.V., Ma Venlo (NL)

( * ) Notice: Subject to any disclaimer, the term of this patent is extended or adjusted under 35 U.S.C. 154(b) by 20 days.

(21) Appl. No.: 10/645,514

(22) Filed: Aug. 22, 2003

(65) Prior Publication Data

US 2004/0036729 A1 Feb. 26, 2004

(30) Foreign Application Priority Data

Aug. 22, 2002 (EP) ..... 02078501

(51) Int. Cl.
*B41J 29/38* (2006.01)

(52) U.S. Cl. ..... 347/14; 347/19

(58) Field of Classification Search ..... 347/14, 347/17–20, 56–59, 60–61, 63–65, 67; 400/120.14
See application file for complete search history.

(56) References Cited

U.S. PATENT DOCUMENTS

| | | | |
|---|---|---|---|
| 5,512,924 A | 4/1996 | Kadowaki et al. | 347/19 |
| 5,519,419 A | 5/1996 | LaDonna et al. | 400/120.4 |
| 6,283,650 B1 | 9/2001 | Hirabayashi et al. | 347/18 |

FOREIGN PATENT DOCUMENTS

EP 0 526 205 A2 2/1993

*Primary Examiner*—Juanita D. Stephens
(74) *Attorney, Agent, or Firm*—Birch, Stewart, Kolasch & Birch, LLP

(57) ABSTRACT

A printing device having multiple print heads is disclosed, which obviates the need to dynamically control temperature differences between distinct print heads. The printing device is provided with a heat exchange device for bringing the temperature of each print head to a predetermined temperature value, and with an adjustment device for adjusting the temperature of one or more print heads from the predetermined temperature values to a static target temperature value. The target temperature values are determined in relation to an output parameter of the printing system such that a minimal adjustment is required. Also disclosed a method for controlling device.

10 Claims, 4 Drawing Sheets

PRINTING DEVICE AND CONTROL METHOD THEREOF

BACKGROUND OF THE INVENTION

This non-provisional application claims priority under 35 U.S.C. § 119(a) on patent application No. 02078501.0, filed in Europe on Aug. 22, 2002, which is herein incorporated by reference.

FIELD OF THE INVENTION

The present invention is related to a printing device such as a printing or copying system employing multiple print heads containing discharge elements for the image-wise formation of dots of a marking substance on an image-receiving member. Examples of such printing devices are inkjet printers and tonerjet printers. Hereinafter reference will be made to inkjet printers.

BACKGROUND OF THE INVENTION

Print heads employed in inkjet printers and the like usually each contain a plurality of discharge elements arranged in (a) linear array(s) parallel to the propagation direction of the image-receiving member (typically paper) or in other words the sub scanning direction. The discharge elements usually are placed substantially equidistant from each other. In operation, the discharge elements are controlled to the image-wise discharge of ink droplets on an image-receiving member so as to form columns of image dots of ink in relation to the linear arrays. The discharge activation may be thermally or thermally assisted and/or mechanically or mechanically assisted and/or electrically or electrically assisted, including piezoelectrically. In scanning inkjet printers, the print heads are supported by a print carriage which is movable across the image-receiving member, i.e. in the direction perpendicular to the propagation direction of the image-receiving member or in other words the main scanning direction. In operation a scanning inkjet printer forms a matrix of image dots of ink corresponding to a part of an image by scanning the print heads at least once, optionally bi-directionally, over the image-receiving member in the main scanning direction. After a first matrix is completed the image-receiving member is displaced to enable the forming of the next matrix. This process may be repeated till the complete image is rendered.

When multiple print heads are employed, due to small deviations between the print heads, including e.g. dimensional variations, variations in the control of the print heads, and variations in the visco-elastic properties of the ink, the size of the image dots resulting from distinct print heads may vary on the image-receiving member. Examples of dimensional variations include differences in nozzle shape or size and differences in the shape or size of the ducts connecting the ink reservoirs with the respective nozzles. These differences may be introduced by the manufacturing process or may arise during extended use e.g. caused by contamination of the ink. An example of a variation in control is e.g. a small deviation in amplitude, shape or timing of the stimulus initiating the discharge of a discharge element. Any variation in the output parameter of distinct print heads, such as e.g., the ink dot size, or the optical density of the image formed, or dot positioning, may cause visual disturbances in the image which is formed. These disturbances are particularly annoying when the distinct print heads discharge ink of the same color. Such variation may be attributed to the print head temperature. In addition to the small deviations between the print heads, as described above, causing static variations, dynamic variations between distinct print heads may also arise, e.g. because of differences in coverage of the image parts which are to be reproduced by the distinct print heads.

In U.S. Pat. No. 6,283,650 a method is disclosed for controlling output levels of an inkjet printer having multiple print heads. Specifically, a dynamic print head temperature control method is disclosed wherein a predetermined relationship between output levels of multiple print heads is maintained by controlling the relative temperature differences between the print heads. To enable this, based on the obtained temperature of an arbitrary one of the multiple print heads, initial target temperatures for each of the multiple print heads are determined. When printing, these target temperatures are dynamically adjusted in order to maintain the predetermined relationship between the output level of the one of the multiple print heads and the output level of each of the multiple print heads.

A disadvantage of the approach as disclosed in U.S. Pat. No. 6,283,650 is that in order to maintain the predetermined relationship in output level, the relative temperature differences between distinct print heads should be that high that the proper functioning of individual print heads is hampered because the target temperature value of the print head is too low or too high. Particularly, when the temperature of a print head is too high a severe deterioration of the print quality may occur due to an increase in dot size and/or the failure of the individual discharge elements due to contamination, whereas when the temperature of a print head is too low, a severe deterioration of the print quality may occur due to a decrease in dot size and/or the failure of individual discharge elements due to the destabilisation of the discharge process. A further disadvantage of the approach as disclosed in U.S. Pat. No. 6,283,650 is that the control, drive and sensing means required to implement such a dynamic control are complex and costly. In operation, the temperature of the print heads rapidly and gradually increase, which affects the output level of the distinct print heads in different ways. According to the approach as disclosed in U.S. Pat. No. 6,283,650, the temperature of each print head needs to be accurately sensed and fed back to a controller which, after consulting predetermined target temperature tables, needs to adequately adjust the temperature of each of the distinct print heads to maintain a predetermined relationship in the output level. To be effective, a sufficiently fast rate temperature adjustment is required, or in other words the time interval between two subsequent adjustments should be small, and the adjustment time should be sufficiently small in order to obtain a more or less continuous temperature adjustment. This is particularly challenging when a print head needs to be cooled to obtain its target temperature.

SUMMARY OF THE INVENTION

It is an object of the present invention to provide a printing device and method which obviates the need to dynamically adjust relative differences in temperature variations of the respective print heads of a printing device.

It is a further object of the present invention to execute minimal static temperature corrections for each of the print heads of a printing device having multiple print heads in relation to a target value of an output parameter of said print heads.

In a first aspect of the present invention a printing device is disclosed having a plurality of print heads for image-wise forming dots of a marking substance on an image-receiving member, comprising: a heat exchange device for bringing the temperature of each of said plurality of print heads to a predetermined set-point temperature value, and an adjustment device for adjusting the temperature of one or more of said plurality of print heads from its predetermined set-point temperature value to an associated target set-point temperature value. Each of said associated target set-point temperature values is determined in relation to a target value of an output parameter of said print heads, said target value of said output parameter being determined on the basis of the respective values of said output parameter for the respective print heads, said respective values being obtained by operating each of said respective print heads at said predetermined set-point temperature value to render a predetermined test pattern, where said target value of said output parameter is determined such that for each of the print heads the absolute value of the difference between said associated target set-point temperature value and said predetermined set-point temperature value with which the temperature of each print head is to be adjusted is 15% of said predetermined set-point temperature value or less. In the rare case, when one or more of the print heads has a target set-point temperature value identical to its predetermined set-point temperature, the adjustment device will perform no temperature adjustment.

The set-point temperature is the temperature which the print head will reach without activating its discharge elements. To set this temperature use can be made of the heat exchange device and/or the adjustment device. According to the present invention, the target value of a selected output parameter is determined such that only minimal adjustment of the set-point temperature value of each of the print heads is required. The advantage hereof is that by doing so the need for dynamic adjustment of the temperature of the respective print heads is obviated as the temperature variations of the respective print heads, while printing, are more alike. In other words, by minimising static temperature corrections for the distinct print heads, the influence of dynamic relative temperature variations of the respective print heads is minimised.

Preferably, to minimise adjustment time, the absolute value of the difference between the associated target temperature value and the predetermined temperature value with which the temperature of each print head is to be adjusted is 10% of the predetermined temperature value or less. Any marking substance can be used provided it can be discharged in fluid form, including e.g. ink.

The image-receiving member may be an intermediate member or a medium. The intermediate member may be an endless member, such as a belt or drum, which can be moved cyclically. The medium can be in web or sheet form and may be composed of e.g. paper, film, cardboard, label stock, plastic or textile.

Further according to the present invention, in order to minimise the differences between the target set-point temperature values of the respective print heads and the predetermined set-point temperature value, the target value of said output parameter is obtained by averaging the respective values of the output parameter for the respective print heads. In an embodiment of the present invention, the target value of the output parameter is obtained by selecting the median value of the respective values of the output parameter for the respective print heads.

In another embodiment of the present invention, the printing device comprises at least two print heads for image-wise forming dots of marking substance of the same color. These at least two print heads may be positioned on the print carriage in any configuration with respect to the main scanning direction including an in-line configuration and a staggered configuration.

In yet another embodiment of the present invention, the printing device comprises a first plurality of print heads for the image-wise formation of dots of a first color and a second plurality of print heads for the image-wise formation of dots of a second color different from the first color, said first plurality of print heads having a corresponding first predetermined set-point temperature value and a first target value of an output parameter, said second plurality of print heads having a corresponding second predetermined set-point temperature value, different from said first set-point temperature value and a second target value of an output parameter.

In another aspect of the invention, a method is disclosed for controlling a printing device having a plurality of print heads for image-wise forming dots of a marking substance on an image-receiving member, the method comprising the steps of: bringing the temperature of each of said plurality of print heads to a predetermined set-point temperature value, determining a target set-point temperature value for one or more of said plurality of print heads, and adjusting the temperature of one or more of said plurality of print heads from its predetermined set-point temperature value to its associated target set-point temperature value, wherein each of said target set-point temperature values is determined in relation to a target value of an output parameter of said print heads, said target value of said output parameter being determined on the basis of the respective values of said output parameter for the respective print heads, said respective values being obtained by operating each of said respective print heads at said predetermined set-point temperature value to render the same image, where said target value of said output parameter is determined such that for each of the print heads the absolute value of the difference between said associated target set-point temperature value and said predetermined set-point temperature value with which the temperature of each print head is to be adjusted is 15% of said predetermined set-point temperature value or less, or 10% of said predetermined set-point temperature value or less. The target value of said output parameter may be obtained by averaging the respective values of the output parameter for the respective print heads. In that case, a target set-point temperature value for each of the respective print heads is determined, and the temperature of each of the respective print heads is adjusted from its predetermined set-point temperature value to an associated target set-point temperature value. Alternatively, the target value may be the value of the output parameter for the print head having the median output parameter value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

In relation to the appended drawings, the present invention is described in detail in the sequel. Several embodiments are disclosed. It is apparent, however, that a person skilled in the art can imagine several other equivalent embodiments or other ways of executing the present invention, the scope of the present invention being limited only by the terms of the appended claims. In particular, the present invention is not limited to inkjet or toner-jet printers of the scanning type, i.e. printers where the print heads are supported by a print carriage which is movable across the image-receiving member, but is also applicable to printers which do not perform a scanning operation in the main scanning direction. The print heads of these latter type printers may have a width, i.e. the maximal distance between discharge elements of a print head in the main scanning direction, equal to or larger than the width, i.e. the dimension in the main scanning direction, of the image-receiving member.

Figure 1:
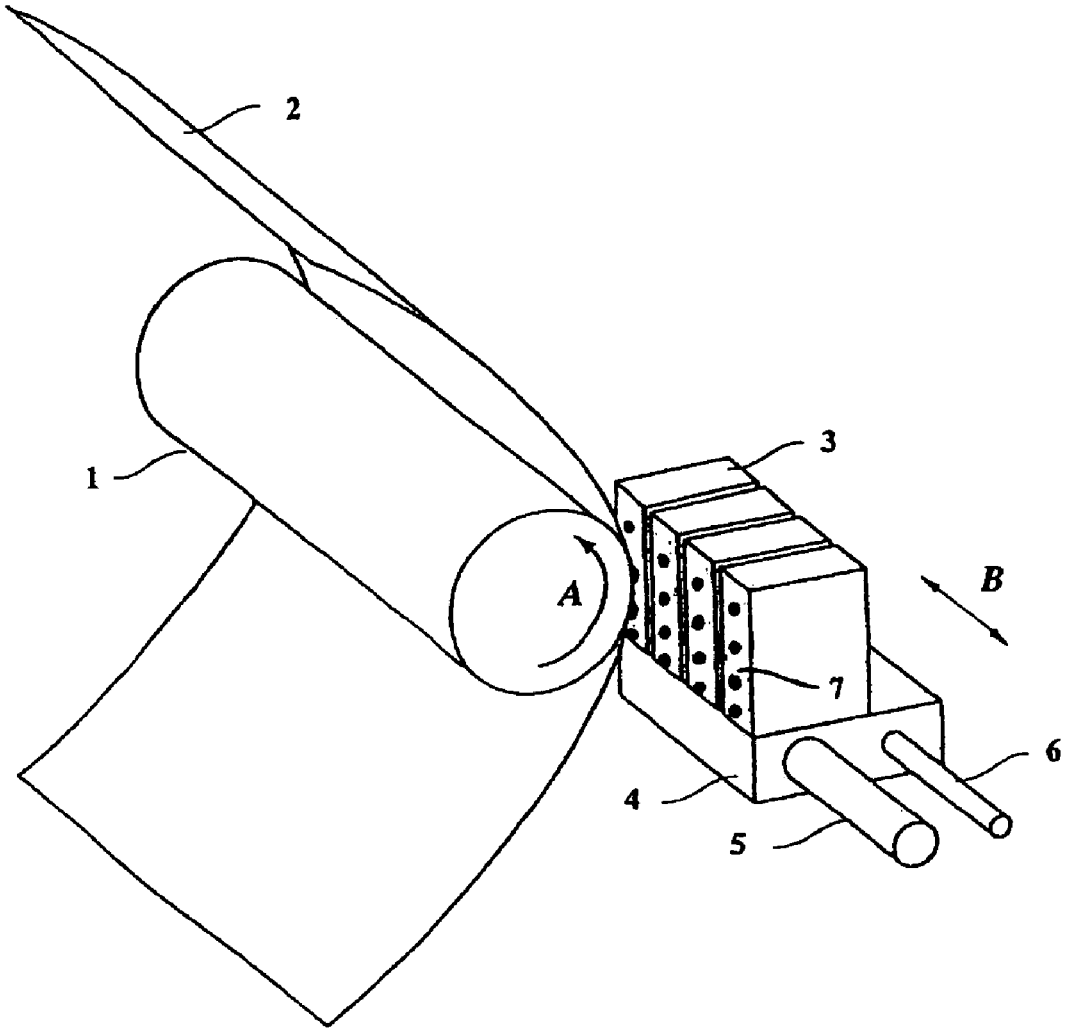
FIG. 1 depicts an example of an inkjet printer.

The printing device of FIG. 1 is an inkjet printer comprising a roller 1 for supporting an image-receiving member 2 which can be moved along four print heads 3 provided with black colored ink. A scanning print carriage 4 carries the four print heads and can be moved in reciprocation in the main scanning direction, i.e. the direction indicated by the double arrow B, parallel to the roller 1, thereby to enable the scanning of the image-receiving member in the main scanning direction. Only four print heads are depicted for demonstrating the present invention. In practice an arbitrary number of print heads may be employed provided this number is at least two. Other print heads may be added, optionally provided with ink of a different color, or existing print heads may be removed or replaced by a print head capable of rendering another color. The color includes black, white and all shades of grey. The roller is rotatable about its axis as indicated by arrow A. The image-receiving member can be a medium in web or in sheet form and may be composed of e.g. paper, cardboard, label stock, plastic or textile. Alternately, the image-receiving member can also be an intermediate member, endless or not. Examples of endless members, which can be moved cyclically, are a belt or a drum. The carriage 4 is guided on rods 5 and 6 and is driven by suitable means (not shown). Each print head comprises a number of discharge elements 7 arranged in a single linear array parallel to the sub scanning direction. Four discharge elements per print head are depicted in the figure, however, obviously in a practical embodiment typically several hundred discharge elements may be provided per print head, and optionally arranged in multiple arrays. As depicted in FIG. 1, the respective print heads are placed parallel to each other such that corresponding discharge elements of the respective print heads are positioned in-line in the main scanning direction. This means that a line of image dots in the main scanning direction can be formed by selectively activating up to four discharge elements, each of them being part of a different print head. This parallel positioning of the print heads with the corresponding in-line placement of the discharge elements is advantageous in increasing productivity and/or improve print quality. Alternatively multiple print heads may be placed on the print carriage adjacent to each other such that the discharge elements of the respective print heads are positioned in a staggered configuration instead of in an in-line configuration. For instance, this may be done to increase the print resolution or to enlarge the effective print area, which can be addressed in a single scan in the main scanning direction.

Figure 2:
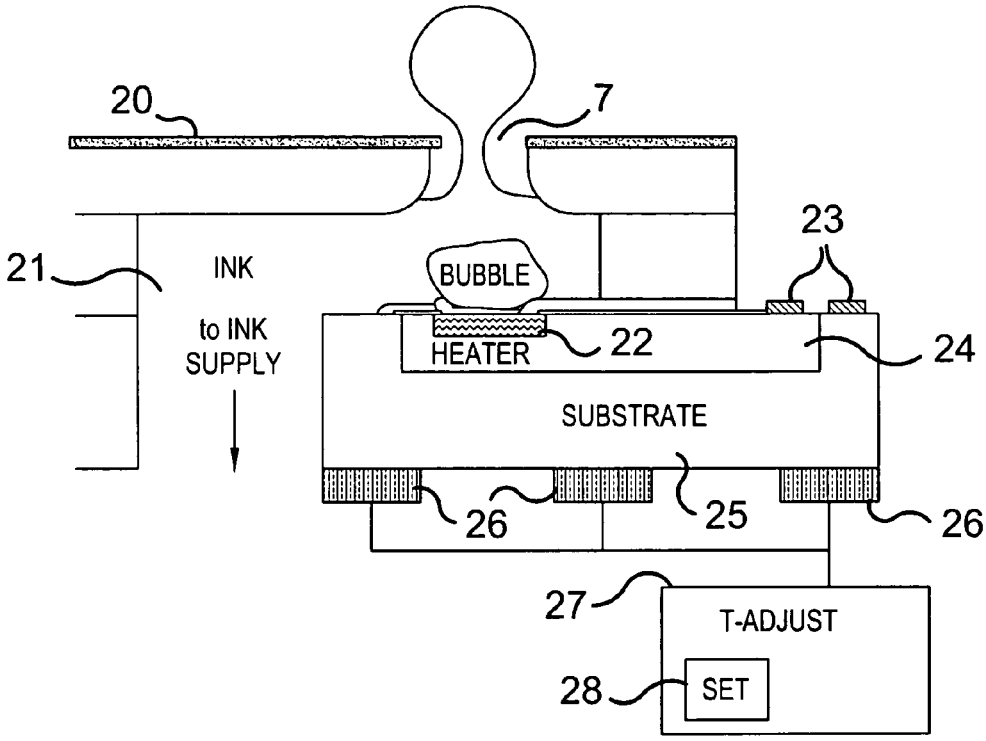
FIG. 2 is a cross-sectional view of a print head of the inkjet printer of FIG. 1.

As depicted in FIG. 2, each discharge element, i.e. the hole in the discharge element plate 20, is connected via an ink duct 21 to an ink supply of the color of the associated print head. Each ink duct is provided with a transducer, which is responsive to an actuation signal. In figure 2, the transducer is a heater element 22. Electrical connections 23 are provided for connecting the heater element with an associated electrical drive circuit. In operation, an electrical signal activates the heater element, which is in thermal contact with the ink in the ink duct. Responsive thereto an ink bubble is created which is discharged by the discharge element 7 in the direction of the image-receiving member 2 such as to form a dot of ink thereon. Alternatively, instead of a thermal activation of the ink duct, the activation may also be thermally assisted and/or piezoelectrically, acoustically or electrostatically assisted. The heater element 22 is separated by an isolating layer 24 from a supporting substrate 25. The isolating layer is a layer with a low thermal and electrical conductance and preferably has a low thermal expansion coefficient. A typical example of such a layer is a $SiO_x$ layer. The supporting substrate 25, which is also in contact with the ink, is preferably composed of a thermally conductive material, such as e.g., silicon. The temperature of the print head as referred to in this disclosure is the temperature of the supporting substrate 25. The static temperature of the print head is the temperature of the supporting substrate of said print head at the start of printing. A heat exchange device 38 may be provided to bring the temperature of the supporting substrate to a predetermined temperature value. For instance the heat exchange device may comprise one or more heater elements and/or one or more cooling elements in thermal contact with the supporting substrate. The heat exchange device may be in direct contact with the supporting substrate. The heat exchange device may also be in contact with the ink. An adjustment device 27 may be provided to adjust the temperature of the supporting substrate from a predetermined temperature value to a target temperature value. The heat exchange device 28 and the adjustment device 27 are operatively connected to heater elements 26. The adjustment device may comprise one or more heater elements and/or one or more cooling elements in thermal contact with the supporting substrate. The heat exchange device may be part of the adjustment device.

EXAMPLE

A printing device as depicted in FIG. 1 is used to reproduce a digital image. A print mode is selected. By selecting a print mode, amongst others a print resolution, a halftoning mask, and a print mask are selected. The print mask contains the information about the number and sequence of printing stages and defines which discharge elements need to be activated, or in other words, contains the information defining for each printing stage which pixels will be rendered by which nozzles such that when all printing stages are completed all the pixels are rendered. A printing stage is a horizontal scanning pass across the image-receiving member in one direction, e.g. from the left to the right, or in other words, a scanning pass in the main scanning direction during which a matrix of image dots is formed. This matrix may be incomplete in the case where the print mask defines multiple printing stages. Print masks are usually configured such as to minimise the influence of random regional variations in dot size and positioning.

Selecting a printing mode enables the user to exchange image quality for productivity and vice versa dependent on the specific requirements. Before the actual start of the printing, the temperature of each of the four print heads is brought to a predetermined temperature value of 40° C. by means of a heat exchange device. Said predetermined temperature value may be chosen independent or dependent of the selected print mode. In the case where the printing device is a multi-color printing device having multiple print heads per color, it may be advisable to choose a different predetermined temperature value for each color in relation to the ink and/or print head characteristics. Moreover in the case where the selected print mode is such that printing is executed bi-directionally, i.e. when scanning in the main scanning direction both from the left to the right and from the right to the left, the predetermined temperature values may be determined, direction dependent. In the latter case, a temperature adjustment may be performed after each printing stage. Such a slow rate of temperature adjustment is far less demanding compared to a fast rate temperature adjustment as employed in a dynamic temperature control process.

Further according to this example, when the predetermined temperature value is reached, a predetermined test pattern of black color is printed on a predetermined image-receiving member, e.g. a 100 gsm coated paper, by each of the four print heads. Suppose the predetermined test pattern is a uniform 50% coverage black patch. Such a simple pattern is chosen solely for instruction purposes as it allows the explaining of the invention in a simple way. In practice, the predetermined pattern typically includes a grey-wedge. Due to small deviations between the print heads, including e.g. dimensional variations, variations in the control of the print heads, and variations in the visco-elastic properties of the ink, the size of image dots formed on the coated paper by the distinct print heads may vary yielding different values for output parameters of the respective print heads. In the case of bi-directional printing, for example, such deviation may be caused by the different location of the satellites on the image-receiving member when printing in the respective directions. For example, when printing from the left to the right satellites fall inside the main droplet on the paper, while when printing from the right to the left, the satellites fall outside the main droplet on the paper.

Figure 3:
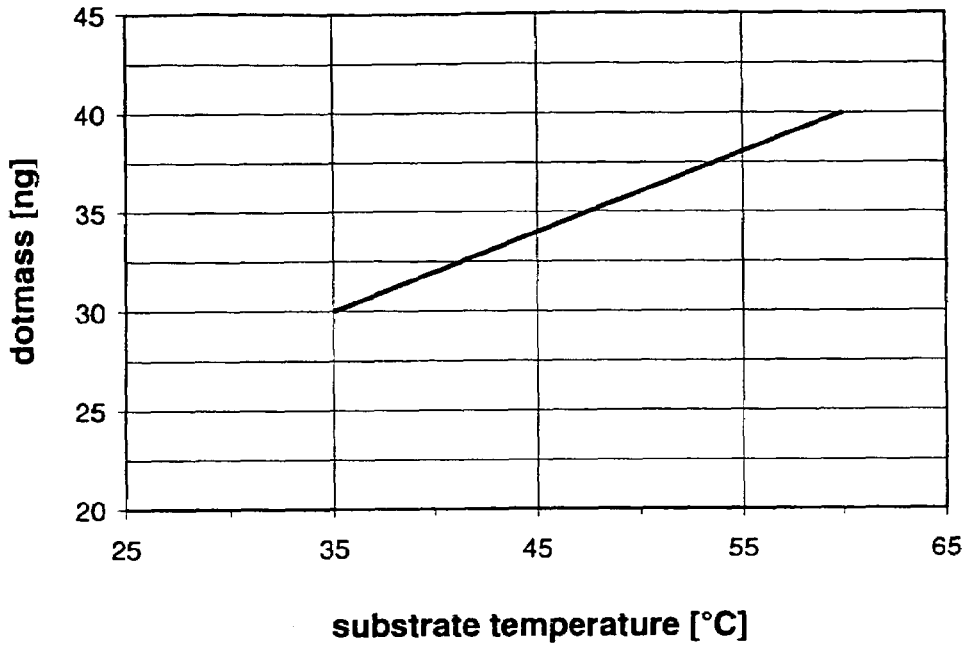
FIG. 3 depicts the dot-mass versus the substrate temperature for black colored ink.
Figure 4:
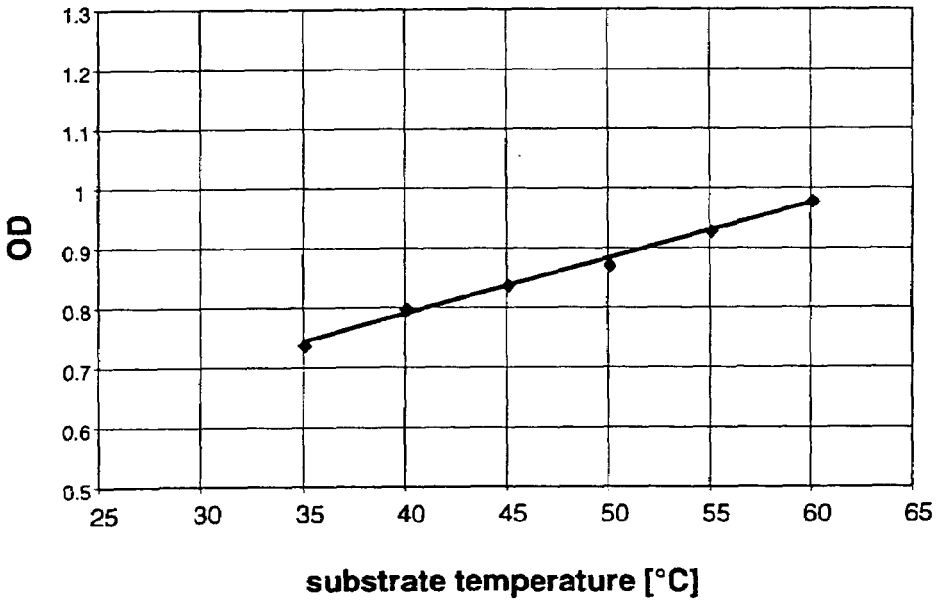
FIG. 4 depicts the optical density (OD) versus the substrate temperature for black colored ink.
Figure 5:
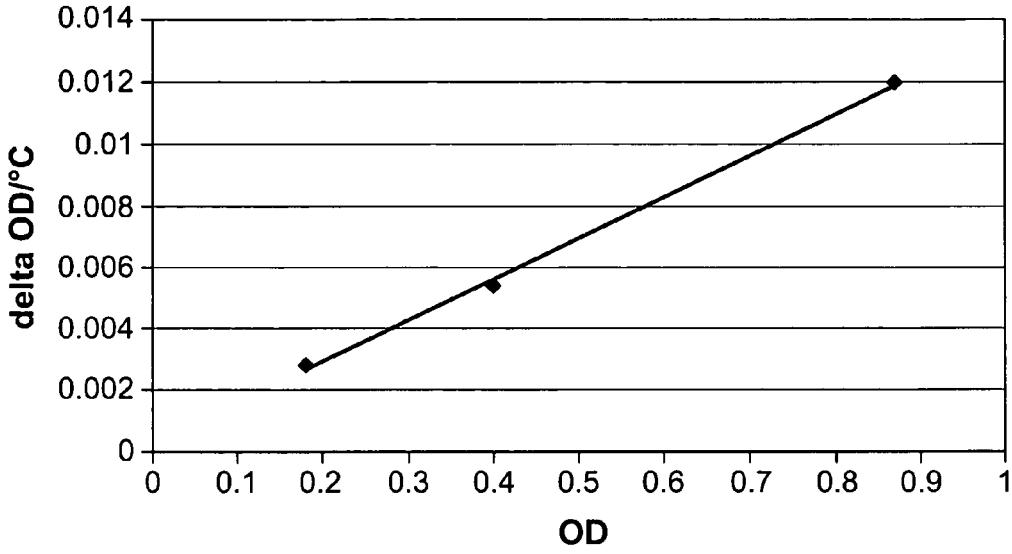
FIG. 5 depicts the change in optical density per degree centigrade versus the optical density for black colored ink.
Figure 6:
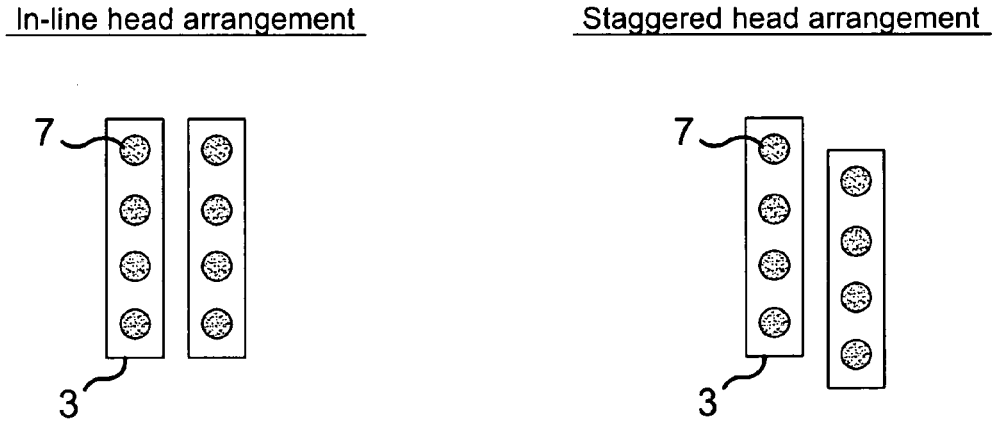
FIG. 6 shows the staggered configuration of two print heads positioned on a print carriage.

An example of an output parameter is the optical density (OD). The optical density is known to correlate with dot size casu quo dot mass. The correlation is such that OD increases with increasing dot size. Measuring OD is therefore indicative for dot size variation. The respective patches printed by the respective print heads are scanned with a scanner in order to determine an OD value for each of the respective patches. The OD values are corrected so as to compensate for any deficiencies and/or dependencies introduced by the paper and/or the scanner. In this example the print head corresponding to the printed patch having a median OD value, is taken as the reference print head. The OD differences, i.e. the differences between the OD values of the respective patches, printed by the respective print heads, and the median OD value, are calculated. When knowing the dependency of OD (see also FIG. 3) casu quo the dot mass (see also FIG. 4) from the temperature of the supporting substrate, the OD differences can be easily converted into temperature differences once the relationship between OD and the substrate temperature is determined (see also FIG. 5). The absolute value of each of the temperature differences is 15% of said predetermined substrate temperature value of 40° C. or less, or preferably 10% or less. Doing so enables one to determine a target temperature value for each other of the respective print heads by adding the associated calculated temperature difference to the predetermined substrate temperature value of 40° C. Alternatively in case the calculated temperature difference is more than the threshold value of 15% or 10% of said predetermined temperature value, then it may be determined to replace the calculated temperature difference value by the threshold value. Subsequently the substrate temperature of each of the other print heads is adjusted to its associated target temperature value. By minimising the static temperature differences of multiple print heads of the same color, the need for expensive dynamic temperature control means is obviated. Moreover, it is observed that when the (static) target temperature values of the respective print heads are within close range, each print head reacts substantially analogous when being subjected to dynamic temperature variations, such that variations in an output parameter which can be contributed to differences between the print heads are minimised resulting in an overall print quality improvement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing device having a plurality of print heads for the image-wise formation of dots of a marking substance on an image-receiving member, comprising:

a heat exchange device for bringing the temperature of each of said plurality of print heads to a predetermined set-point temperature value, and an adjustment device for adjusting the temperature of one or more of said plurality of print heads from its predetermined set-point temperature value to an associated target set-point temperature value, wherein each of said associated target set-point temperature values is determined in relation to a target value of an output parameter of said print heads, said target value of said output parameter being determined on the basis of the respective values of said output parameter for the respective print heads, said respective values being obtained by operating each of said respective print heads at said predetermined set-point temperature value to render a predetermined test pattern, where said target value of said output parameter is determined such that for each of the print heads the absolute value of the difference between the associated target set-point temperature value and the predetermined set-point temperature value with which the temperature of each print head is to be adjusted is 15% or less of said predetermined set-point temperature value.

2. The printing device as recited in claim 1, wherein said absolute value with which the temperature of each print head is to be adjusted is 10% or less of said predetermined set-point temperature value.

3. The printing device as recited in claim 1, wherein said target value of said output parameter is obtained by averaging said respective values of said output parameter for the respective print heads.

4. The printing device as recited in claim 1, wherein the target value of said output parameter is obtained by selecting the median value of said respective values of said output parameter for the respective print heads.

5. The printing device as recited in claim 1, comprising at least two print heads for the image-wise formation of dots of marking substance of the same color.

6. The printing device as recited in claim 5, wherein said at least two print heads are positioned on a print carriage in a staggered configuration with respect to said scanning direction.

7. The printing device as recited in claim 1, comprising a first plurality of print heads for the image-wise formation of dots of a first color and a second plurality of print heads for the image-wise formation of dots of a second color different from said first color, said first plurality of print heads having a corresponding first predetermined set-point temperature value and a first target value of an output parameter, said second plurality of print heads having a corresponding second predetermined set-point temperature value, different from said first temperature value and a second target value of an output parameter.

8. A method for controlling a printing device having a plurality of print heads for the image-wise formation of dots of a marking substance on an image-receiving member, comprising the steps of:

bringing the temperature of each of said plurality of print heads to a predetermined set-point temperature value, determining a target set-point temperature value for one or more of said plurality of print heads, and adjusting the temperature of one or more of said plurality of print heads from its predetermined set-point temperature value to its associated target set-point temperature value, wherein each of said target set-point temperature values is determined in relation to a target value of an output parameter of said print heads, said target value of said output parameter being determined on the basis of the respective values of said output parameter for the respective print heads, said respective values being obtained by operating each of said respective print heads at said predetermined set-point temperature value to render the same image, where said target value of said output parameter is determined such that for each of the print heads the absolute value of the difference between said associated target set-point temperature value and said predetermined set-point temperature value with which the temperature of each print head is to be adjusted is 15% or less of said predetermined set-point temperature value.

9. The method as recited in claim 8, wherein said target value of said output parameter is obtained by averaging said respective values of said output parameter for the respective print heads.

10. The method as recited in claim 9, wherein a target set-point temperature value for each of said plurality of print heads is determined, and the temperature of each of said plurality of print heads is adjusted from its predetermined set-point temperature value to its associated target set-point temperature value.

* * * * *